US011122942B2

(12) United States Patent
Young

(10) Patent No.: US 11,122,942 B2
(45) Date of Patent: Sep. 21, 2021

(54) CAROUSEL STYLE DISPENSER

(71) Applicant: San Jamar, Inc., Elkhorn, WI (US)

(72) Inventor: Michael Young, Mukwonago, WI (US)

(73) Assignee: San Jamar, Inc., Elkhorn, WI (US)

( * ) Notice: Subject to any disclaimer, the term of this patent is extended or adjusted under 35 U.S.C. 154(b) by 353 days.

(21) Appl. No.: 16/274,716

(22) Filed: Feb. 13, 2019

(65) Prior Publication Data

US 2020/0253431 A1 Aug. 13, 2020

(51) Int. Cl.
*A47K 10/38* (2006.01)
*A47K 10/32* (2006.01)

(52) U.S. Cl.
CPC .. *A47K 10/3818* (2013.01); *A47K 2010/3233* (2013.01)

(58) Field of Classification Search
CPC ..... A47K 10/3818; A47K 10/3836; A47K 10/3687; A47K 2010/3233; A47K 2010/3253
See application file for complete search history.

(56) References Cited

U.S. PATENT DOCUMENTS 1,716,812 A * 6/1929 Ball ..... B65H 19/1852 242/422.6
3,552,669 A * 1/1971 Earnest ..... A47K 10/38 242/594.6
4,108,513 A * 8/1978 Lander ..... A47K 10/3836 225/34
4,557,426 A 12/1985 Siciliano
5,310,129 A 5/1994 Whittington et al.
5,636,812 A * 6/1997 Conner ..... A47K 10/3836 242/559.2
6,491,251 B1 * 12/2002 Stanland ..... A47K 10/3687 242/559.2
6,648,267 B2 11/2003 Stanland et al.
7,014,140 B2 * 3/2006 Elliott ..... A47K 10/3687 242/559.2

(Continued)

FOREIGN PATENT DOCUMENTS

CA 2292374 12/2000
CA 2583594 9/2001

(Continued)

OTHER PUBLICATIONS

The European Communication with the European Extended Search Report, dated Sep. 30, 2020.

*Primary Examiner* — Michael E Gallion
(74) *Attorney, Agent, or Firm* — Boyle Fredrickson, S.C.

(57) ABSTRACT

A dispenser assembly that includes a carousel tray and is operable to allow the user to selectively orient one of a plurality of respective discrete rolls of web material supported by the carousel tray proximate a dispense opening. An elongate user actuated lever arm is accessible from outside the dispenser housing and operable to allow the user to manually rotate the carousel tray relative to the housing to present each discrete roll of web material proximate the dispense opening for use. In preferred embodiments, the dispensing assembly includes one or more indexing and/or brake assemblies that are configured to inhibit inertial rotation of the carousel and/or to resist rotation of the carousel beyond a desired radial location absent user interaction with the lever arm.

26 Claims, 9 Drawing Sheets

(56) References Cited

U.S. PATENT DOCUMENTS

| | | | | |
|---|---|---|---|---|
| 7,044,419 | B2 * | 5/2006 | Moore | B65H 35/00 242/559.2 |
| 7,114,676 | B2 | 10/2006 | Elliott et al. | |
| D543,502 | S | 5/2007 | Goeking et al. | |
| D543,745 | S | 6/2007 | Goeking et al. | |
| D556,482 | S | 12/2007 | Goeking et al. | |
| 7,461,810 | B2 * | 12/2008 | Goeking | A47K 10/38 242/559.1 |
| 8,356,767 | B2 * | 1/2013 | Formon | A47K 10/3836 242/559.2 |
| 8,479,957 | B2 * | 7/2013 | Ophardt | A47K 10/3818 222/192 |
| 2018/0325332 | A1 * | 11/2018 | Grosz, Jr. | A47K 10/3656 |

FOREIGN PATENT DOCUMENTS

| | | |
|---|---|---|
| CA | 2583685 | 9/2001 |
| CN | 2427504 Y | 4/2001 |
| EP | 1559356 | 8/2005 |
| EP | 1656869 A2 | 5/2006 |
| GB | 2245882 A | 1/1992 |

* cited by examiner

CAROUSEL STYLE DISPENSER

BACKGROUND OF THE INVENTION

The present application relates generally to dispensers that are constructed to dispense rolled web materials—such as hand towel and toilet tissue materials, and more particularly, to a dispenser assembly having a manually actuated rotatable carousel that supports multiple discrete rolls of web material and which is operable to present the discrete rolls proximate a dispense opening of the dispenser assembly in a sequential manner.

In an effort to minimize the frequency associated with restocking rolled web material dispenser assemblies—such as restroom hand towel and toilet tissue dispensers, such dispensers have advanced in two principle directions. Some dispensers attempt to maximize their storage capacity through the use of one or perhaps two substantially large volume rolls of web material. Alternatively, other dispenser assemblies attempt to resolve service frequency issues through simultaneous onboard storage of a plurality of rolls of web material. Some approaches deploy rotatable turntables or slideable access door assemblies associated with providing the selective access to the discrete rolls of web material when desired. In many such embodiments, web material is dispensed from one roll while the remaining rolls are stored in reserve until they are moved into a dispensing position and preferably only once the roll currently at the dispensing position has been depleted. Some such dispensers rely on gravity feed arrangements and others provide rotational drive arrangements that allow the user to selectively advance a subsequent roll of web material to a dispense position.

Some dispensers configured for dispensing large volume rolls of web material suffer from disadvantages associated with incompatibility to dispense traditional or standard rolls of web material thereby making restocking efforts more burdensome. Still other rotatable turntable style dispensers have relatively complex mechanical constructions, often require significant force to advance subsequent rolls of web material to a dispense location, are susceptible to improper use of the advancement mechanism resulting in damage to the dispenser assembly and/or undesired advancement of rolls of web material away from the dispense location prior to complete depletion of the discrete roll, and advancement assemblies that do not provide readily repeatable indexing or preferred positioning of the discrete rolls of web material relative to the dispense opening. It is appreciated that various prior art web material dispensers having onboard storage and selectively operable advance mechanisms suffer from one or more of the above drawbacks.

Accordingly, there is a need for web material dispenser assembly that is configured to accommodate onboard storage of multiple discrete rolls of web material, such as toilet tissue, and that has an improved advancement actuation mechanism having a robust construction and whose operation is intuitive to users. There is a further need for improves in the simplicity, elegance or esthetic appearance of the dispenser and manually operated advancement mechanism and which provides a reduction of the forces required for operation of the advancement mechanism. There is a further need for a carousel style dispenser assembly that is constructed to advance a plurality of rolls of web material to a dispense position through activation of an elongated lever actuator. There is a further need for a carousel style dispenser that includes an advancement and actuation system that provides repeatable and relatively secure positioning of the discrete rolls of web material relative to the dispense opening defined by the dispenser assembly.

SUMMARY OF THE INVENTION

The present invention discloses a carousel style dispenser of rolled web material that resolves one or more of the shortcomings disclosed above.

One aspect of the present application discloses a dispenser assembly having a housing that includes a base and a cover that defines a cavity within the housing. A tray or turntable is disposed within the interior of the housing and is configured to rotate in a generally vertical manner relative to the housing. The turntable includes a plurality of spindles that each extend in a generally horizontal manner from a surface of the turntable. The plurality of spindles constructed and oriented relative to one another and the turntable to such that each spindle is oriented to receive a respective discrete roll of web material. A user actuated lever arm is accessible from outside of the housing and connected to the turntable via a drive mechanism. The lever arm, turntable and drive mechanism provide a rotational linkage that is configured to effectuate rotation of the turntable in response to annular translation of the lever arm relative to the housing to present each respective spindle proximate the dispensing opening in the housing in a generally sequential manner associated with each actuation of the lever arm.

Another aspect of the present invention is directed to providing at least one interference arrangement that is configured to resist rotation of the turntable if the actuation lever is manipulated to effectuate an advancement operation prior to depletion of a discrete roll of web material disposed proximate the dispense opening defined by the housing of the dispenser assembly. A further aspect of the present application usable with one or more of the above aspects discloses at least one indexing arrangement that is configured provide one or more of a tactile or audible indication of discrete roll of web material having been positioned proximate the dispensing opening. Preferably, the at least one indexing arrangement is configured to resist rotation of the turntable relative to the housing during initial actuation of the advancement mechanism to mitigate incidents of advancement operations due to inadvertent user interaction with the actuation lever arm. Alternatively, more than one indexing arrangement can be provided between the rotational operational of the turntable and the housing of the dispenser assembly.

A further aspect of the present application that is useable or combinable with one or more of the above aspects discloses a brake arrangement that is disposed between the turntable and the housing of the dispenser assembly. Preferably, the brake arrangement includes a number of braking surfaces that are equal in number to the number of spindles supported by the turntable such that a respective braking activity is actuated during each turntable advancement actuation. Each braking arrangement is configured to mitigate inertial or momentum rotation of the turntable during each advancement operation due to uneven or unbalanced weighted loading of the turntable due to the mass of the remaining onboard stowed rolls of web material.

Another aspect of the present application that includes one or more features or aspects useable with one or more of the above aspects discloses a dispenser assembly for dispensing multiple rolls of web material. The dispenser assembly includes a housing that is defined by a base and a cover that cooperate with one another to define an interior of the housing. A dispense opening is formed through the housing and oriented to allow the extraction of the web material therefrom. A turntable is disposed within the interior of the housing and configured to rotate within the housing in a generally vertical manner about a drive shaft. The turntable has a plurality of spindles that extend from a first surface of the turntable and that are each configured to receive a respective roll of web material. The dispenser assembly includes a lever arm that is accessible from outside the housing. A drive mechanism is disposed between the lever arm and the turntable and configured such that annular rotation of the lever arm in one direction rotates the turntable and rotation of the level arm in an opposite direction does not affect a position of the turntable relative to the housing.

Another aspect of the present application discloses a drive shaft having a geometric cross section about an end thereof and a turntable hub having a slot configured to mate with the geometric cross section of the end of the drive shaft such that a selectively separable rotational driving arrangement is provided between the turntable and the rotational drive arrangement.

A further aspect of the application that is useable or combinable with one or more of the above features or aspects discloses a method of forming a dispenser assembly that is constructed to dispense multiple discrete rolls of web material. The method includes providing a housing that is shaped to generally enclose a cavity and define a dispense opening that is formed through the housing. A turntable is supported in the housing such that the turntable is rotatable relative to the housing and has a plurality of spindles that are each constructed to support a roll of web material. A drive mechanism that includes a lever that is accessible from outside the housing is provided and is supported by the housing such that the drive mechanism is operable to rotate the turntable relative to the housing upon rotation of the handle relative to the housing in one direction. In a preferred aspect, an indexing system is provided and disposed between the housing and the turntable to stall rotation of the turntable with each actuation of the lever in the one direction so that one of the plurality of spindles is generally aligned with the dispense opening.

These and other aspects, features, and advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
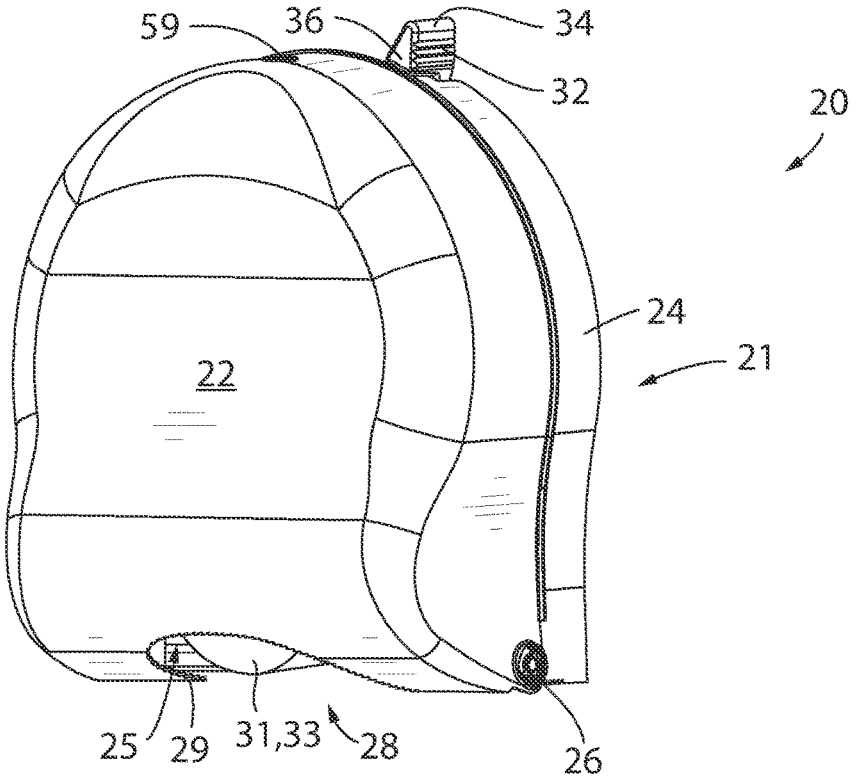
FIG. 1 is an front perspective view of a carousel dispenser assembly according to the present invention.
Figure 2:
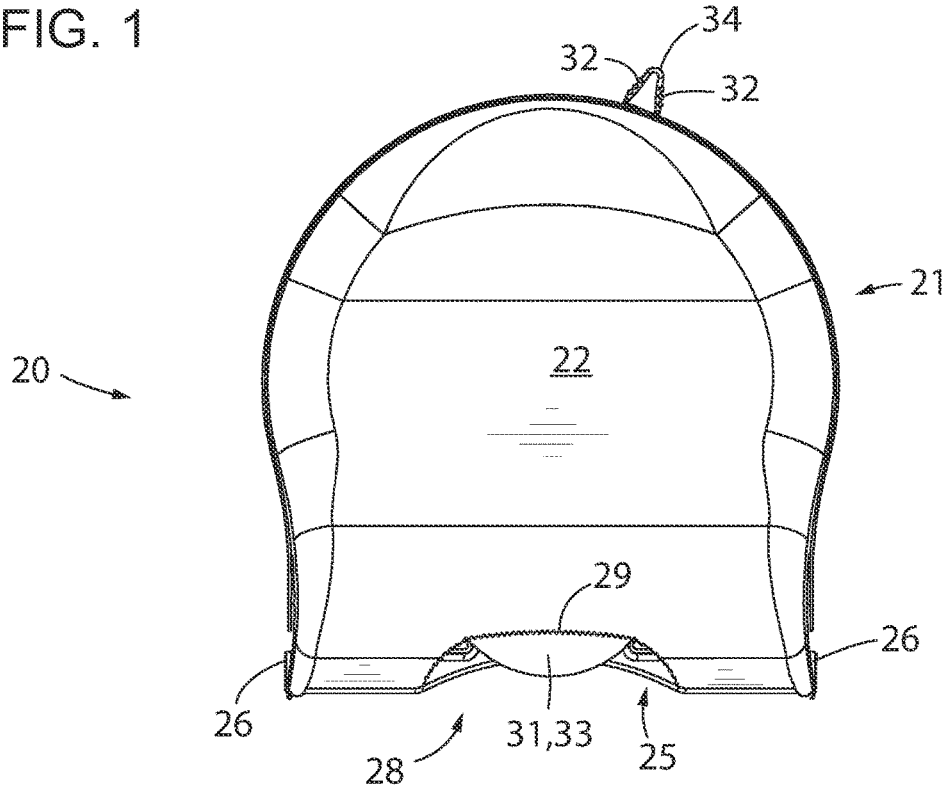
FIG. 2 is a front elevation view of the dispenser assembly shown in FIG. 1.
Figure 3:
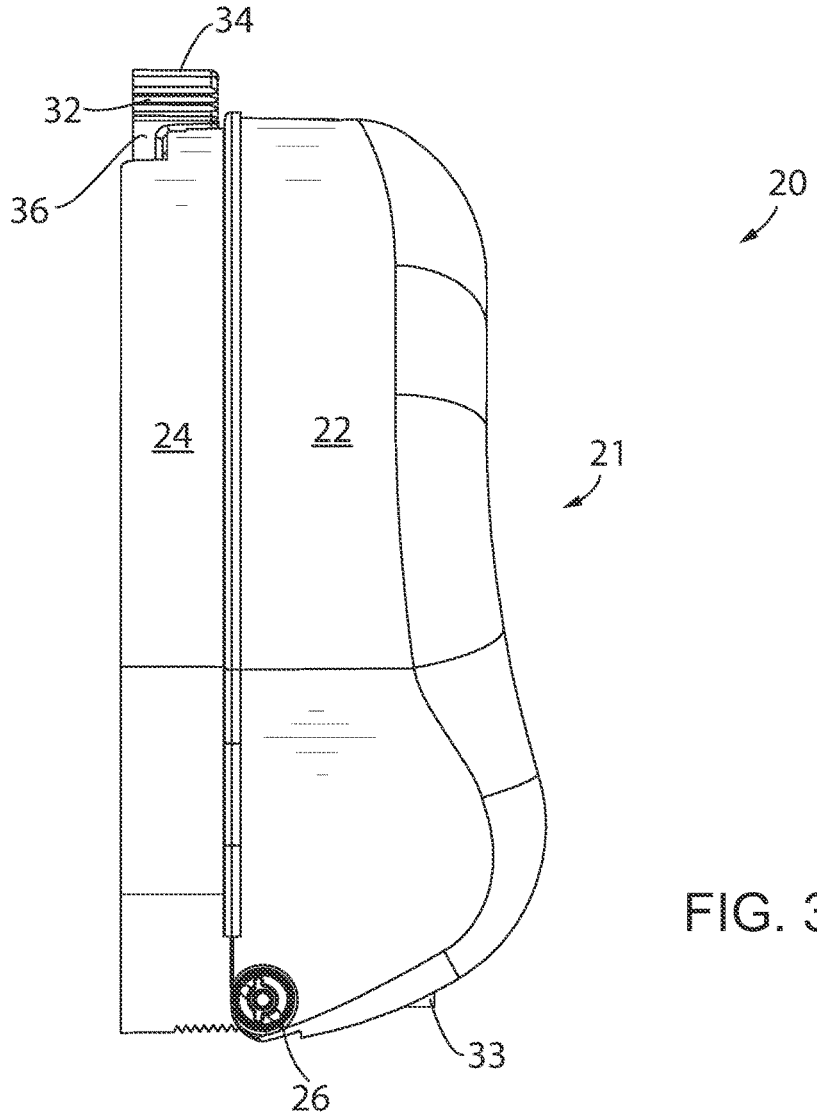
FIG. 3 is a side elevation view of the dispenser assembly shown in FIG. 1.

In describing the preferred embodiments of the invention as illustrated in the drawings, specific terminology will be resorted to for the sake of clarity. It is not intended that the invention be limited to the specific terms so selected and it is to be understood that each specific term includes all technical equivalents which operate in a similar manner to accomplish a similar purpose. The various features and advantageous details of the subject matter disclosed herein are explained more fully with reference to the non-limiting embodiments described in detail in the following description.

Illustrative embodiments of carousel dispenser or carousel dispenser assembly 20 in accordance with various aspects of the present invention are shown in FIG. 1 through FIG. 14. While the dispenser assembly 20 as described herein and shown in FIGS. 1 through 14 is configured to retain and dispense four discrete rolls of web material, i.e., toilet tissue, it should be understood that the present invention is not so limited and that alternative numbers, i.e., more or fewer, discrete rolls of web material are considered within the scope of this invention as are those dispensers that dispense alternative types of rolled web material.

FIGS. 1-5 show various views of a dispenser assembly 20 according to the present invention. Dispenser assembly 20 includes an enclosure or a housing 21 that is defined by a cover 22 that is moveably connected to a base portion or a base 24. As disclosed further below, cover 22 is pivotably connected to base 24 are allows selective user access to a cavity or interior 25 of housing 21 of the dispenser assembly 20. Cover 22 is moveable relative to base 24 and is preferably pivotably affixed to base 24 such that cover 22 is rotatable relative to base 24 about one or more bosses or hinge or pivot points 26 that are located at generally opposite lateral sides proximate the bottom of housing 21 of dispenser assembly 20. Housing 21 is shaped to define a generally downward directed dispense passage or opening 28 that provides access to a discrete roll of web material 31 that is positioned in a lowest, i.e., dispensing position 33, as disclosed further detail below.

Figure 4:
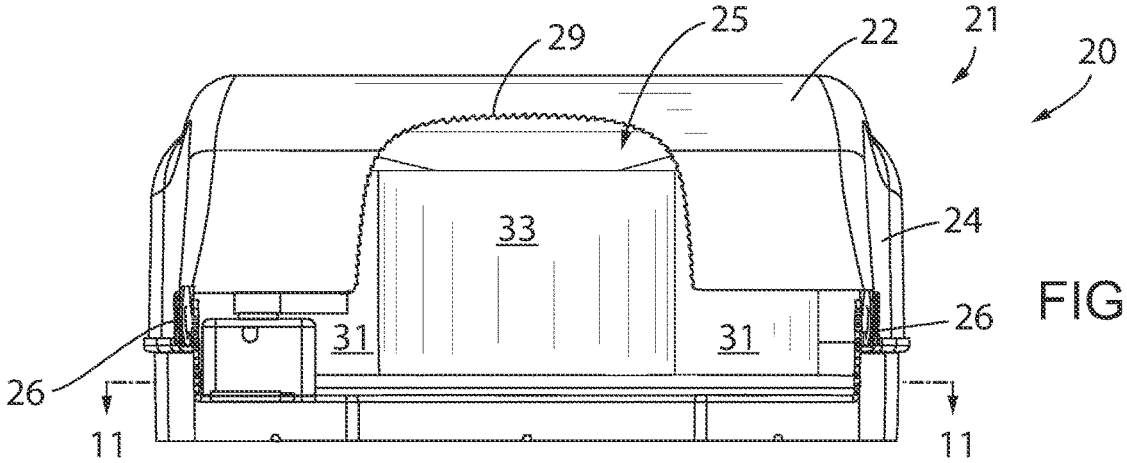
FIG. 4 is a bottom plan view of the dispenser assembly shown in FIG. 1.

Referring to FIGS. 1 and 4, at least a portion of a perimeter of the opening 28 preferably includes a jagged or serrated edge 29 to facilitate tearing of the web material from a discrete roll during each dispense operation. Housing 21 further includes a lock or locking mechanism 30 that is preferably provided proximate the top of the dispenser assembly 20, opposite hinge points 26, and is configured to selectively secure cover 22 relative to base 24. As shown in FIGS. 1-3 and 5, a handle 32 is located on an upper end 34 of an elongated lever arm, advancement lever, or simply lever 36 that extends from a rear surface of the base 24 and above the top of the dispenser assembly 20. Whether housing 21 is in an open configuration or a closed configuration, handle 32 remains accessible to allow user interaction therewith. Handle 32 preferably extends above the top edge of cover 22 such that it is readily accessible to a user for advancing the rolls of web material as described in further detail below.

Figure 5:
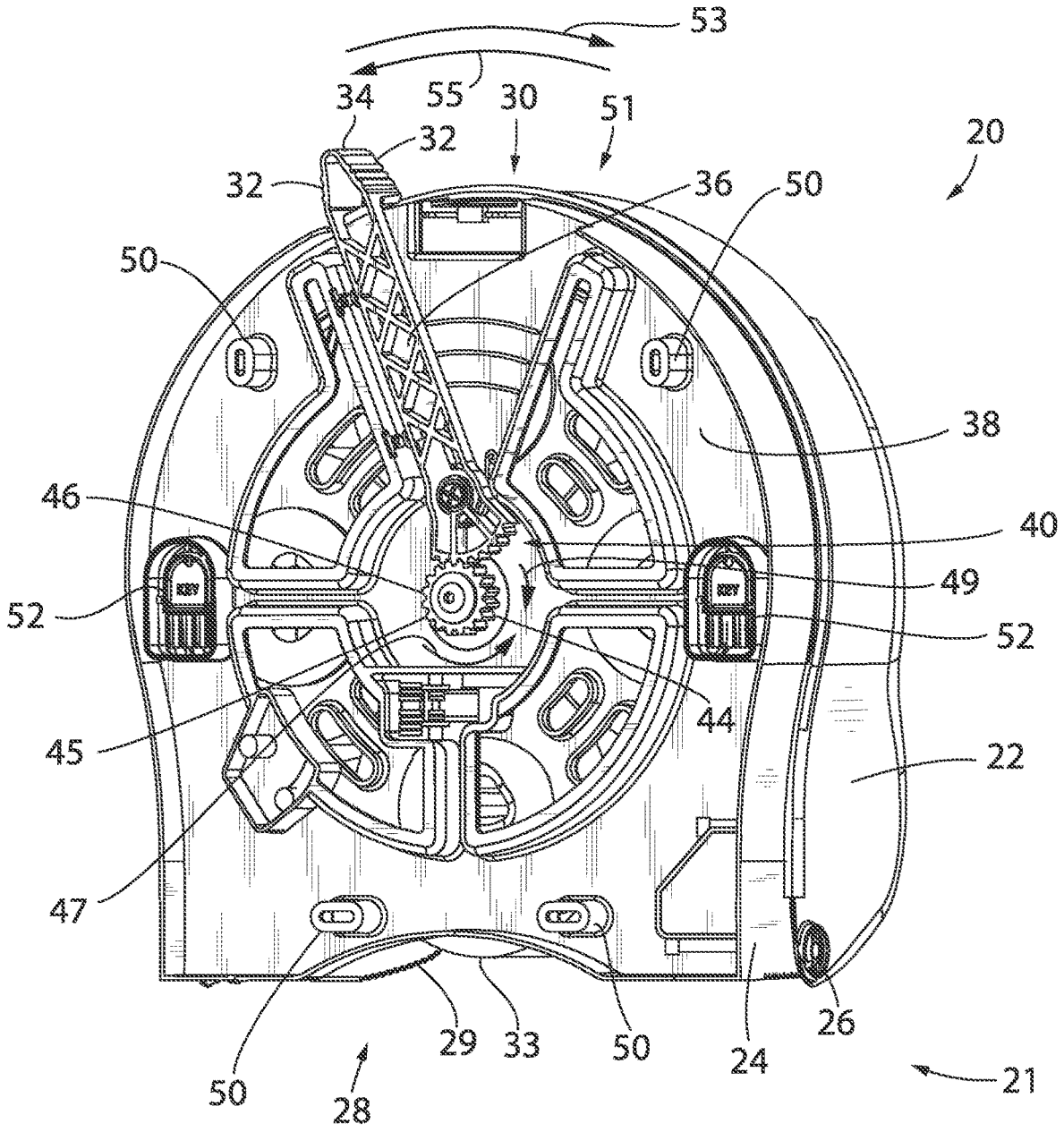
FIG. 5 is a rear perspective view of the dispenser assembly shown in FIG. 1.

As shown in FIG. 5, elongated lever 36 extends along a rearward facing or outer surface 38 of base 24 of housing 21. Elongated lever 36 extends between an upper end 34 that generally defines handle 32 and an opposing lower end 40 that is engaged with a drive mechanism associated with effectuating advancement of discrete rolls of web material to the dispense location as disclosed further below. Lower end 40 of lever 36 includes a drive arrangement 42 in the form of a series of cog or gear teeth 43 that are disposed about an arcuate surface that contacts and mechanically engages a gear 44 disposed about a drive shaft 46. It should be appreciated that teeth 43 associated with lever 36 and gear 44 cooperate in a generally rack and pinion manner wherein the rack structure or drive arrangement 42 receives an input signal from a user and effectuates rotation of gear 44 in response thereto.

The elongated lever 36 is pivotably affixed to the back, rearward facing, or outer surface 38 of base 24 at a pivot point 48 that offset slightly above the lower end 40 of the lever 36. As will be described in further detail below, engagement of the handle 32, for use in advancing the web material relative to dispenser assembly 20, includes translating the handle 32 in an arcuate or annular manner across the top surface of the base 24, such that the lever 36 pivots about the pivot point 48 and teeth 43 engage the gear 44 to rotate the drive shaft 46. The length of the elongated lever 36, which is preferably between 6.0 inches and 12.0 inches from the pivot point 48 to the handle 32, and the dissimilar lengths associated with the effort arm and the resistance arm associated with the offset distances to the fulcrum defined by pivot point 48, provided by the relative distances between pivot point 48 and teeth 43 and pivot point 48 and handle 32, reduces the magnitude of the user applied force that is required to engage the gear 44 and rotate the drive shaft 46 of the dispenser assembly 20 even when dispenser assembly 20 is fully loaded with multiple discrete rolls of web material.

Figure 6:
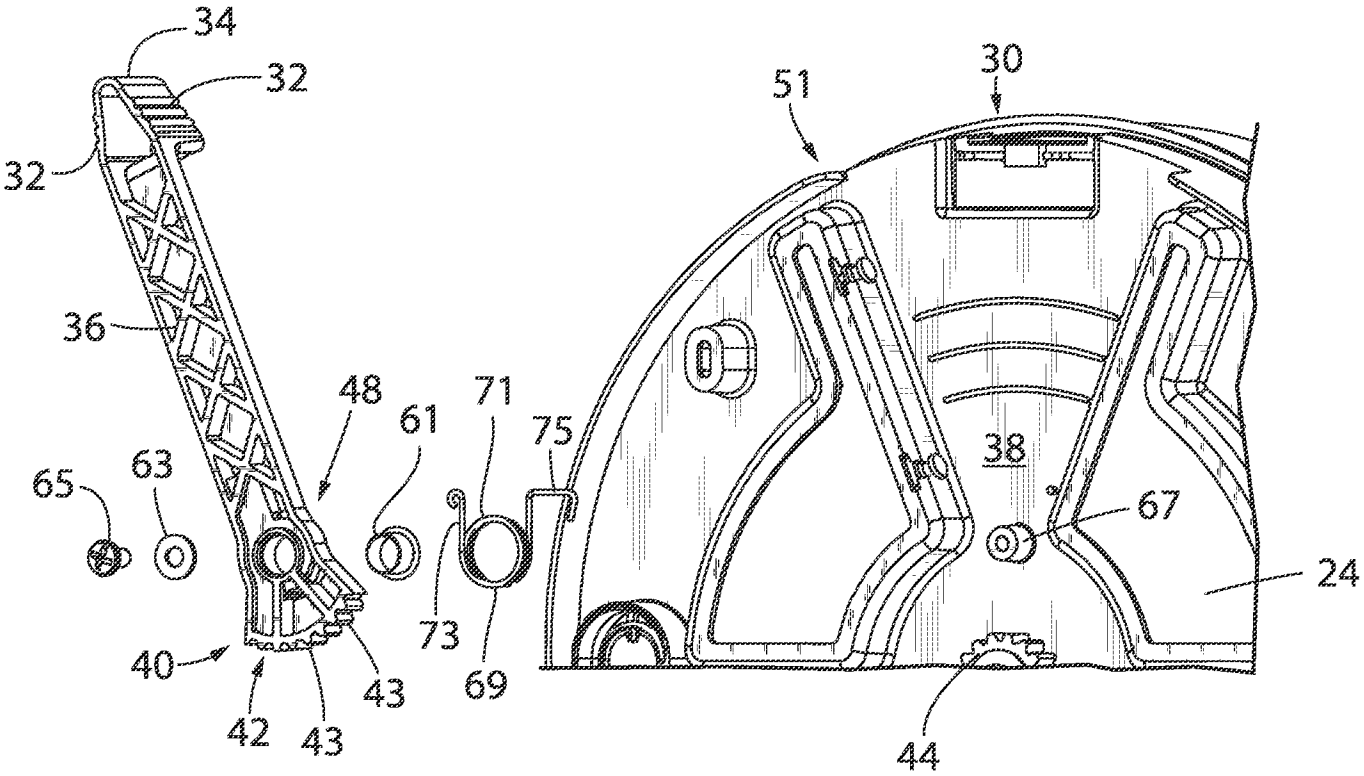
FIG. 6 is a partial rear perspective view of the dispenser assembly shown in FIG. 5 with an actuator lever arm assembly exploded from a base of the dispenser assembly.

Referring to FIGS. 5 and 6, a rearward facing surface 38 of base 24 includes an arcuate channel 51 that is shaped to accommodate the pivotable translation of lever 36 about pivot point 48 relative to base 24 while maintaining an operative engagement between teeth 43 and gear 44. A one way bearing or clutch bearing 45 is disposed between gear 44 and drive shaft 46. Clutch bearing 45 is configured to effectuate rotational engagement between gear 44 and shaft 46 in a first rotational direction, indicated by arrow 47, and allow relative rotation between gear 44 and shaft 46 in the opposing rotational direction, indicated by arrow 49. Such a construction allows annular translation of handle 32 relative to base 24 in direction 53 to effectuate rotation of gear 44—and thereby shaft 46, and allow translation of handle 32 in an opposite direction, indicated by arrow 55 without imparting a rotational force to shaft 46.

As shown in FIG. 6, a journal 61, a cap 63, and a fastener 65 secure lever 36 to a boss 67 associated with pivot point 48 and that extends in a rearward direction from base 24. A biasing device, such as a torsion spring 69, includes a barrel portion 71 that is located about boss 67 and includes a pair of respective legs 73, 75 that extend therefrom. Legs 73, 75 cooperate with lever 36 and base 24 and exert an opposing force on the lever 36 to return the lever 36 and its handle 32 portion to an original, ready to advance, at rest, or starting position relative to base 24. In this configuration, it should be understood that the starting position of the handle 32, i.e., right or left side of the base 24 is adjustable and may be selected depending upon the preferred or most ergonomic operation of the dispenser assembly 20 based upon its installation location and/or orientation relative to a user. Referring to FIGS. 5 and 6, upon a roll advancement instruction, when the user fully advances the handle 32 across the top surface of the base 24 in direction 53, drive shaft 46 rotates a portion of a full 360 degree rotation that corresponds to advancing an adjacent roll of web material 31 into the dispensing position 33 associated with opening 28. Upon completion of each advancement operation of lever 36, torsion spring 69 returns lever 36 toward the ready to advance position. Clutch bearing 45 accommodates the rotation of lever 36 in the reverse rotational direction toward the ready to advance position without affecting the relative rotational orientation of drive shaft 46, and thereby the web material supporting turntable, relative to dispenser housing 21 and dispense opening 28.

In a preferred aspect, each advancement operation of lever 36 relative to housing 21 effectuates a desired rotation of a tray, carousel, or turntable disposed in housing 21 to effectuate advance of a respective roll of web material to the dispense position. It is appreciated that other methodologies may be employed, such as two or more "pumps" or operations of lever 36 effectuating the desired advancement of the discrete rolls of web material relative to the dispense opening 28. Although one operation of the lever 36 is desirable, other numbers of operation of lever 36 are envisioned and although possible, it is further preferred that no partial "pumps" or strokes of lever 36 in the advancement direction are required to achieve the desired sequential presentation of each discrete roll of web material at an orientation aligned with the dispense opening of dispenser assembly 20 as disclosed further below with respect to FIGS. 7-14.

Still referring to FIG. 5, the outer rearward facing surface 38 of base 24 may also include or more bosses or installation anchor mounting points 50 for securing the dispenser assembly 20 in a substantially vertical orientation via cooperation with wall hanging fasteners or the like. The outer surface 38 may also contain one or more removable keys 52 for allowing selective operation of the locking mechanism 30 when replacing depleted rolls of web material or otherwise servicing dispenser assembly 20. As shown in FIG. 1, cover 22 includes a key slot 59 shaped to cooperate with a portion of a respective key 52 to facilitate opening cover 22 relative to base 24 for restocking or service activities.

Figure 7:
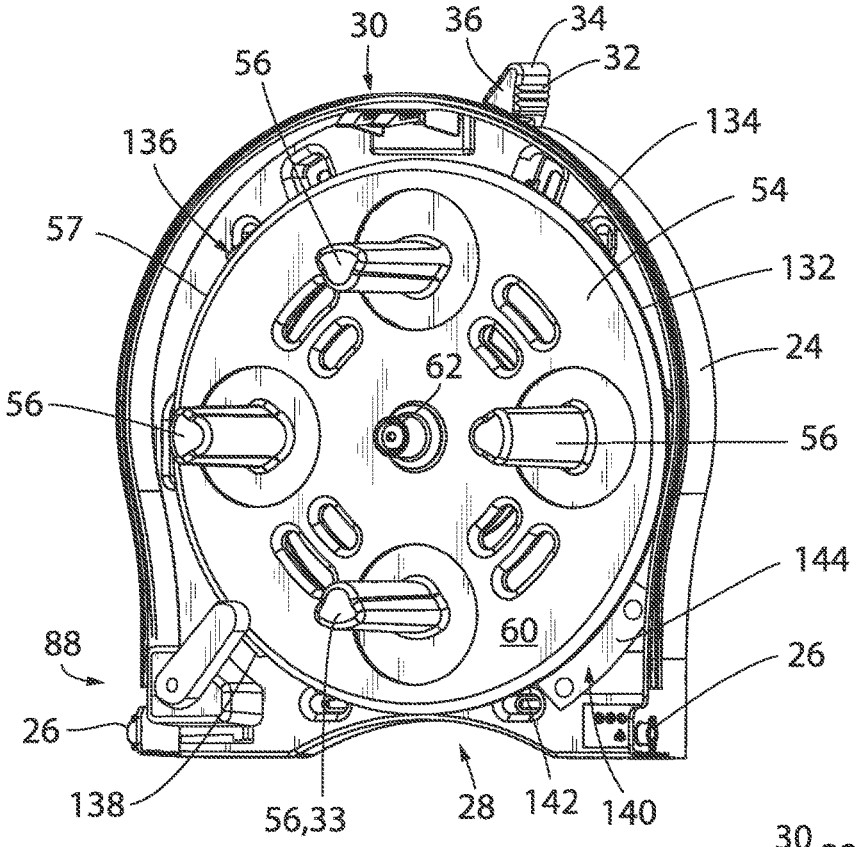
FIG. 7 is a view similar to FIG. 1 and shows the dispenser assembly shown therein with a cover removed to expose a rotatable turntable disposed within the dispenser assembly.
Figure 8:
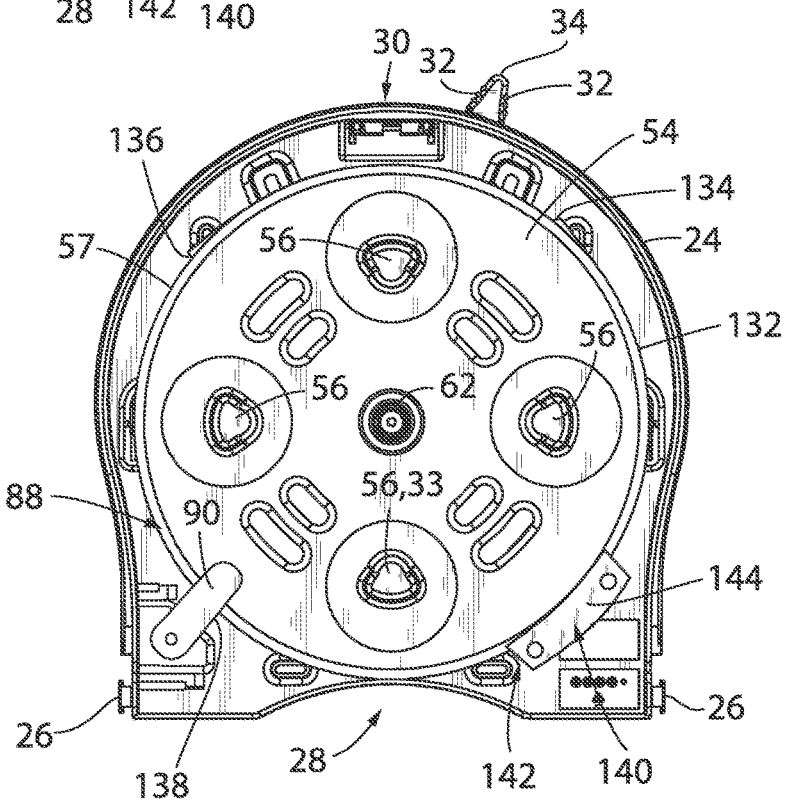
FIG. 8 is a front elevation view of the dispenser assembly shown in FIG. 7 with the cover removed therefrom.

Referring to FIGS. 7 and 8, dispenser assembly 20 is shown with cover 22 removed therefrom. A tray, carousel, or a turntable 54 is disposed within the interior of the dispenser assembly 20 and includes a number of posts or spindles 56 that extend in a generally horizontal manner therefrom. Although four spindles 56 are shown, it is appreciated that turntable 54 could be constructed to include other numbers of spindles such as 2, 3, 5, 6, etc. Regardless of the number of spindles, the spindles 56 are preferably annularly spaced in an equidistant manner relative to each other generally about a perimeter 57 of the turntable 54. Referring briefly to FIGS. 4, 7, and 8, each spindle 56 is oriented to receive an individual roll of web material 31 such as toilette tissue thereon. As shown in FIGS. 1, 2, 4, 7, and 8, one of the spindles 56, and its corresponding roll of web material 31, is indexed and positioned adjacent opening 28 defined by housing 21 and is located in the dispensing position 33 as previously described. It should be appreciated from the disclosure provided above, that operation of lever 36 relative to housing 21 effectuates rotation of turntable 54 relative to housing 21 and sequentially advances each of the respective spindles 56, and the roll of web based material associated therewith, to the dispense position associated with the proximity to dispense opening 28.

It is appreciated that although the spindle 56 associated with opening 28 is generally centrally positioned thereof, other orientations of spindles 56 relative to opening 28 may be provided to achieve alternate dispense positions. That is, the respective spindles 56 may be oriented rotationally forward or rearward relative to an imaginary centerline of opening 28 when in the dispense location depending on the clockwise or counterclockwise orientation of the discrete rolls relative to opening 28. Regardless of the specific relative orientation of spindles 56 relative to opening 28, operation of lever 36 preferably effectuates a repeatable presentation of the discrete spindles 56 relative to opening 28 with each advancement operation effectuated by the user.

Figure 9:
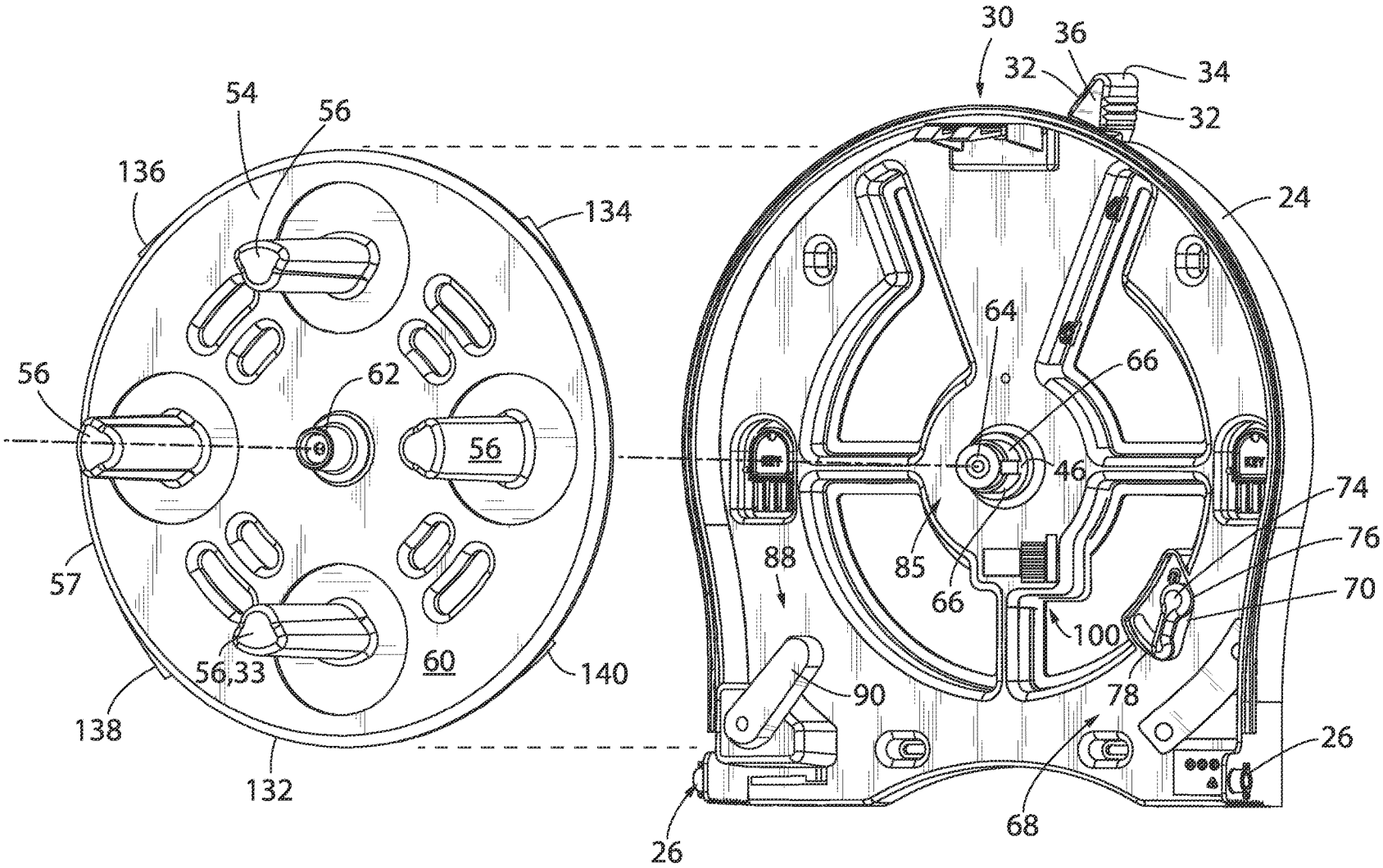
FIG. 9 is a view similar to the FIG. 7 with the turntable exploded from the dispenser assembly.
Figure 10:
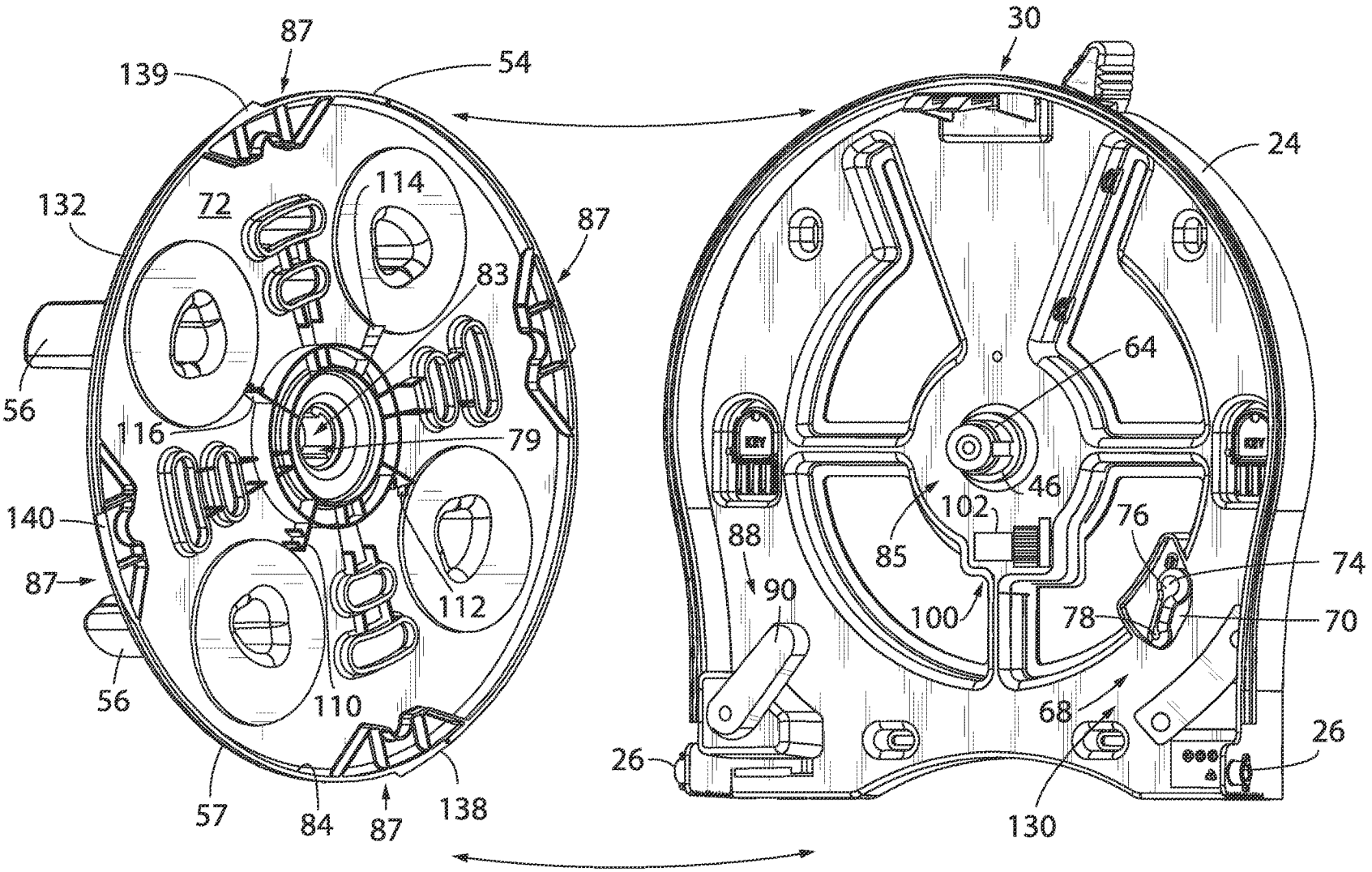
FIG. 10 is a view similar to FIG. 9 but shows the turntable rotated about a vertical axis to expose a base facing side of the turntable relative to a turntable facing side of the base of the dispenser assembly.

Referring to FIGS. 7-10, dispenser assembly 20 is shown absent both cover 22 and the plurality of rolls of web material 31. In this unobstructed view, each of the spindles 56 are shown extending from a front surface 60 of the turntable 54 and include a generally irregular polygonal cross section configured to engage and securely retain the core or radially inward facing surface of a roll of web material 31 engaged therewith, while allowing the rolls to rotate relatively freely during use. Turntable 54 includes a generally centrally located drive shaft receiving hub 62 that extends forward from the front surface 60 of the turntable 54. As shown in FIG. 10, the interior or base facing surface 72 of turntable 54 proximate the receiving hub 62 defines a receiving slot 79 that is shaped to slideably mate with a turntable or front end or forward facing portion 64 of drive shaft 46 (FIGS. 9 and 10).

A splined or keyed drive arrangement 83, 85 is defined between turntable 54 and drive shaft 46 such that rotation of drive shaft 46 in response to operation of lever 36 effectuates rotation of turntable 54 relative to housing 21. The slidable cooperation of the geometric configuration of the annular ridges 66 located about front end or forward facing portion 64 of the drive shaft 46 are received within a reciprocally shaped receiving slot 79 within the base facing side of hub 62 of turntable 54 so as to define slideable keyed drive arrangement 83, 85 therebetween. In this configuration, rotation of the drive shaft 46, via manual operation of lever handle 32, is translated to the hub 62 of turntable 54 with minimal slippage of the rotational interaction therebetween.

Figure 14:
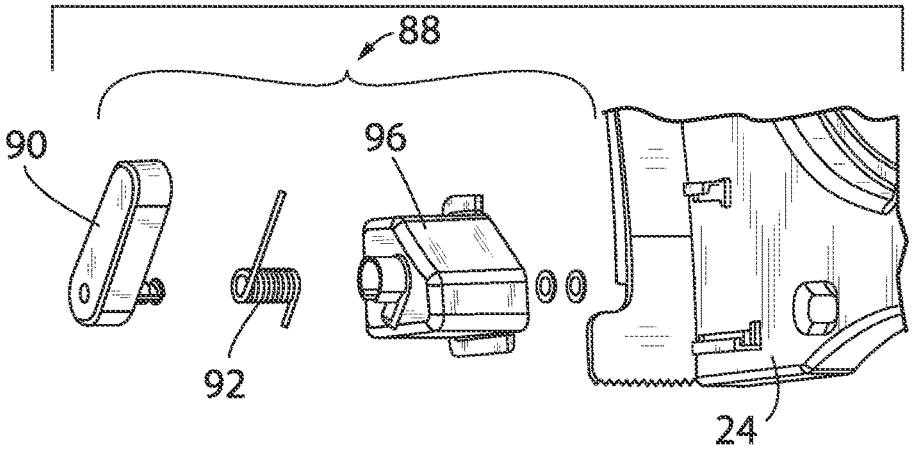
FIG. 14 is an exploded perspective view of another indexer assembly of the dispenser assembly shown in FIG. 1.

Referring to FIGS. 9 and 14, dispenser assembly 20 preferably includes one or more indexing assemblies associated with providing one or more of an audible, tactile, or physical interaction between turntable 54 and housing 21 and which is constructed to provide an indicia or resistance to rotation of the turntable relative to the housing when the turntable 54 is oriented in each respective radial or rotational position indicative of one of spindles 56 being oriented in the desired rotational dispense location relative to housing 21 and opening 28. Regardless of the number or placement of the discrete indexing assemblies and the operating methodology as providing a catch, stop, or braking arrangement, the one or more indexing assemblies are preferably constructed and configured to provide resistance to rotation of turntable 54 relative to housing 21 that is less than the force associated with operation of lever 36. Said in another way, operation or implementation of the one or more indexing systems 68, 88, 100, 130 as disclosed further below are each preferably configured to yield to allow rotation of turntable 54 in response to user actuation or operation of advancement lever 36. Such a consideration ensures continued operability of dispenser assembly 20 even in the event of undesired premature operation of lever 36 due to young, inexperienced, or nefarious users.

A first indexing arrangement or assembly 68 is disposed in a recess 70 formed between the base facing surface 72 of turntable 54 and turntable facing surface of base 24. The indexing assembly 68 includes a catch or an indexing lever 74 having a first bulbous end 76 offset from a second bulbous end 78 and a biasing device such as a torsion spring 80 disposed to act upon the indexing lever 74. The indexing lever 74 is pivotably affixed within the recess 70 about a first bulbous end 76. An arm 82 of the torsion spring 80, which is mounted between the interior surface 72 of the base 54 and indexing lever 74 extends from the first bulbous end 76 towards the second bulbous end 78 and exerts a radially outward directed biasing force on the indexing lever 74. In this configuration, the second bulbous end 78 of the indexing lever 74 is forced into contact with a radially inward directed outer perimeter wall 84 (FIG. 10) of the turntable 54 at the rear or base facing surface 72 of the turntable 54.

Figure 11:
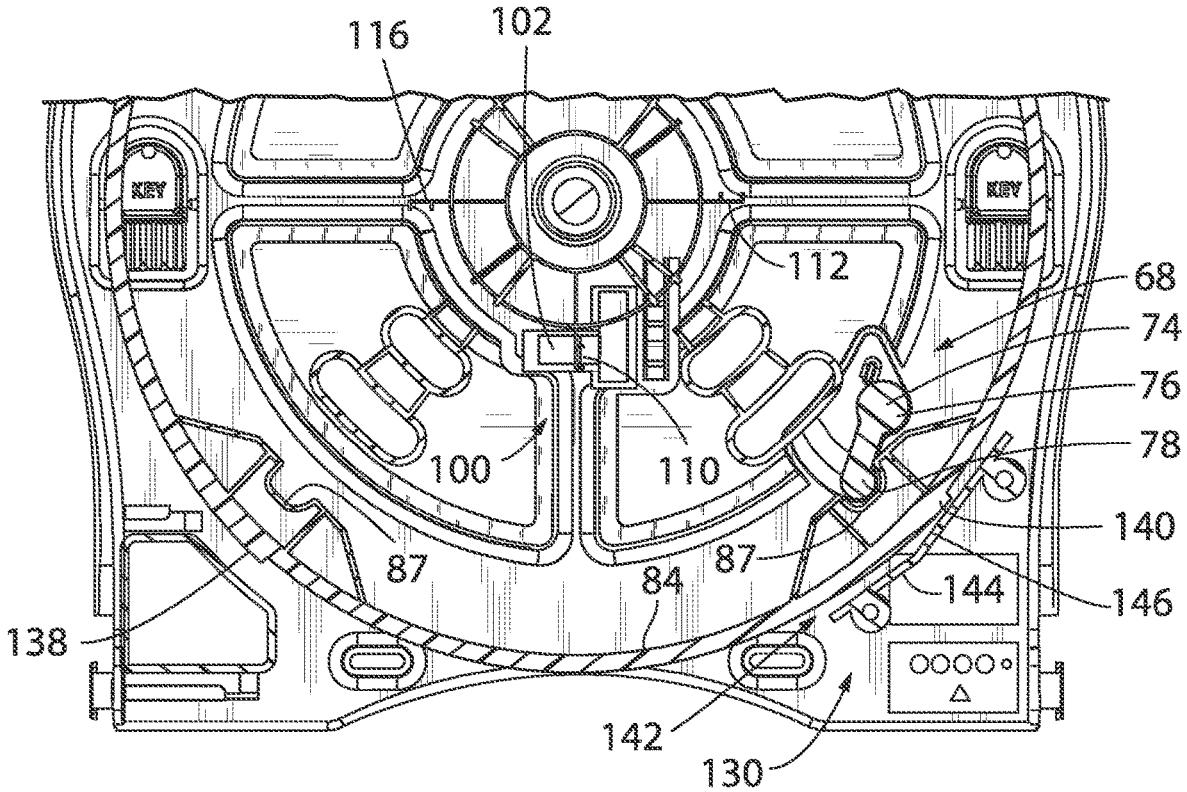
FIG. 11 is a partial elevation cross section view of the dispenser assembly shown in FIG. 1 taken along line 11-11 shown in FIG. 3.
Figure 12:
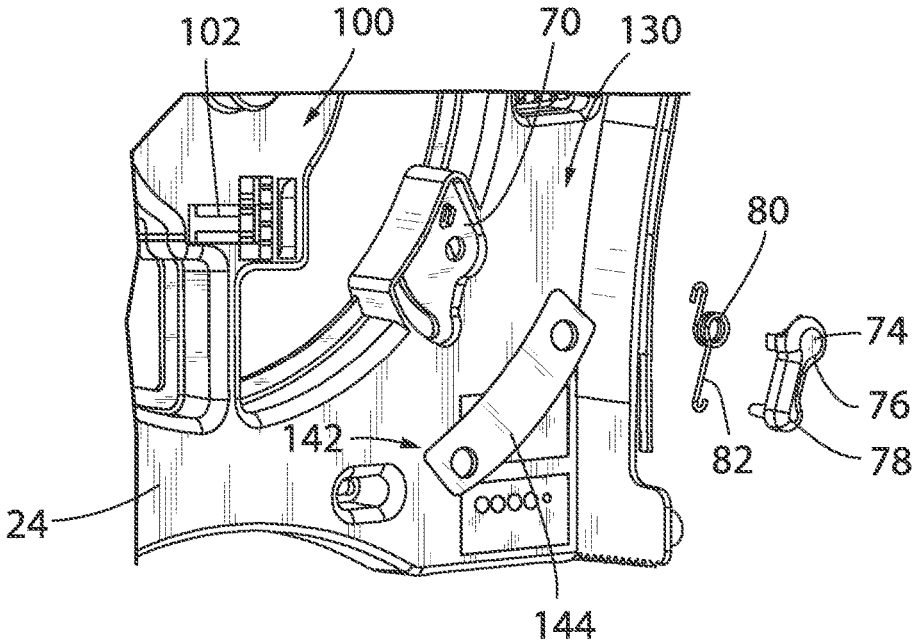
FIG. 12 is an exploded perspective view of an indexer assembly shown in FIG. 11.
Figure 13:
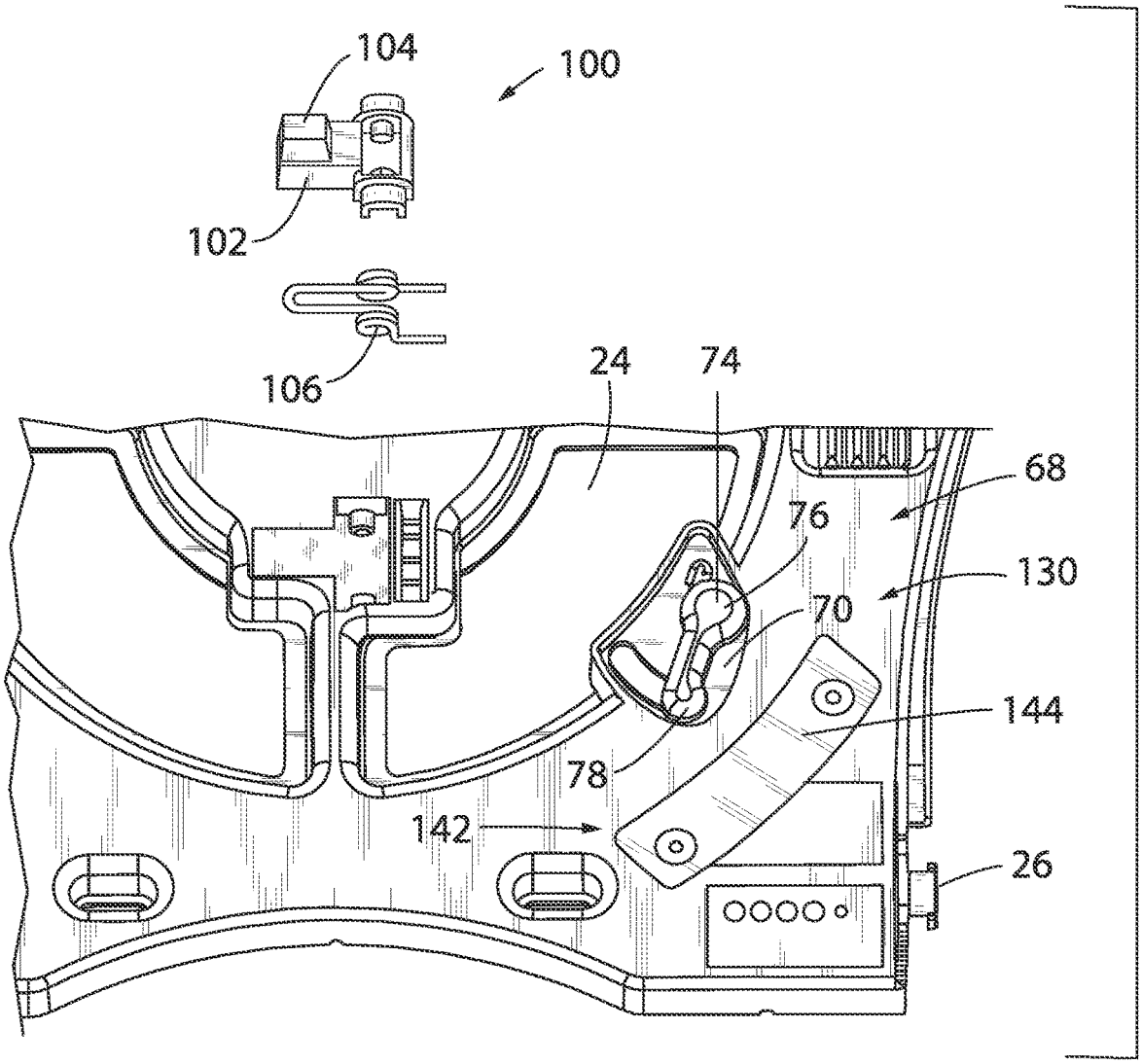
FIG. 13 is a upwardly directed perspective view of a portion of dispenser assembly shown in FIG. 11 with another indexer assembly exploded therefrom.

A plurality of indexing slots or channels 87 are formed by the radially inward facing surface associated with perimeter wall 84 and are each shaped to cooperate with end 78 of indexing lever 74. As shown in FIG. 10, a plurality of channels 87 are formed about the circumference proximate the perimeter of turntable 54 and oriented to sequentially interact with indexing lever 74 as turntable 54 rotates relative to base 24. Channels 87 are uniformly distributed about the perimeter of turntable 54 such that the channels 87 are equidistant from one another such that the same operation of or number of operations of lever 36 relative to base 24 effectuates rotational advancement of turntable 54 to allow the cyclic interaction of indexing lever 74 with each of channels 87. Channels 87 and indexing lever 74, and the operative association provided thereby, are annularly offset from the relative respective locations of spindles 56 relative to turntable 54. As shown in FIG. 11, the trough associated with each channel 87 defined by turntable 54 is configured to receive and retain the second bulbous end 78 of the indexing lever 74 and inhibit rotation of the turntable 54 in the absence of a user applied force to the handle 32 of the lever 36.

Although indexing lever 74 is shown as being pivotably supported by base 24 and turntable 54 is shown as defining a plurality of channels 87 configured to cooperate with the indexing lever 74, it is appreciated that this construction could be reversed. That is, the function of indexing lever 74 could be supported by turntable 54 and configured to cooperate with one or more channels defined by base 24 and which are radially positioned about the rotational circumference associated with turntable 54. Such alternative constructions are appreciated and within the scope of the appending claims.

Regardless of the specific orientation of the indexing lever 74 and channels 87 relative to turntable 54 and base 24 or housing 21, during use, the user applied force, i.e., lateral movement of the handle 32 of the actuation lever 36 will induce a rotation of the drive shaft 46, which is translated to a rotation of the turntable 54 via the mating linkage of the annular ridges 66 at the forward facing portion 64 of the drive shaft 46 and the corresponding receiving slot of the hub 62. Resultantly, the turntable 54 will rotate and advance a spindle 56 containing a roll of web material 31 towards the dispense opening 28 defined by housing 21. When the spindle is rotationally advanced into the dispensing position, i.e., downwardly located, indexing assembly 68 will engage so as to inhibit further rotation of the turntable 54 relative to housing 21. Namely, the second bulbous end 78 of the indexing lever 74 will deflect into one of the respective indexing slots or channels 87 located at the radially inward facing outer perimeter wall 84 and rear surface 86 of the turntable 54. Torsion spring 80 will exert a holding force on the indexing lever 74 sufficient to inhibit further rotation of the turntable absent user activation of the lever 36, which generates sufficient rotational force within the turntable to overcome the retention force of the torsion spring 80 in the indexing assembly 68.

In one aspect of the present application, dispenser assembly 20 may include additional or alternative indexing structures that are configured to selectively suspend or terminate rotation of turntable 54 relative to housing 21 to maintain a respective spindle 56 relative to the dispense opening with each or a required number of actuations of the externally accessible lever 36. Referring to FIGS. 7-10 and 14, dispenser assembly 20 can include an additional or alternative indexing assembly 88 that is configured to interact with the discrete rolls associated with the discrete spindles 56 rather than interact directly with turntable 54.

As shown in FIGS. 8 and 14, indexing assembly 88 is disposed generally proximate dispense opening 28 defined by housing 21 and proximate pivot point 26. Indexing assembly 88 comprises a bypass arm 90 that extends into and overlaps an area associated with the rolls of web material. Preferably, when located in a dispense position, bypass arm 90 does not interfere with rotation of the discrete rolls of web material relative to the respective spindle 56 upon which they rest during the dispense operation. As shown in FIG. 14, a biasing device, such as a torsion spring 92, is disposed between a mount body 96 and bypass arm 90 and oriented to bias bypass arm toward a position wherein the bypass arm overlaps a sweep area associated with rotation of full rolls of web material beyond the dispense position. In the event a user repeatedly actuates advancement lever 36 when a non-depleted roll of web material is associated with the dispense position, bypass arm 90 will yield to an orientation wherein the non-fully depleted roll of web material is allowed to translate past the bypass arm 90 without damage thereto. When a full roll of web material is advanced to the dispense location, contact of the roll with the bypass arm 90 hinders continued rotation of turntable 54 relative to housing 21 such that the discrete roll is retained at the dispense location until the respective roll of web material has been depleted or otherwise used.

In yet a further aspect of the present invention, dispenser assembly 20 includes an additional indexing assembly 100 that is oriented nearer the axis of rotation of turntable 54 than either of indexing assemblies 68, 88. As shown in FIGS. 10-13, indexing assembly 100 includes a catch or lever body 102 that is pivotably supported by a pair of bosses defined by base 24. Lever body 102 includes a projection 104 that extends into an area between turntable 54 and base 24. A biasing device, such as a torsion spring 106 interacts with base 24 and lever body 102 to bias lever body 102 into a position wherein projection 104 extends toward the base facing side of turntable 54. As shown in FIG. 10, base facing side of turntable 54 includes one or more ridges, projections, or spokes 110, 112, 114, 116, that each extend toward base 24 and which are uniformly circumferentially spaced from one another. Spokes 110, 112, 114, 116 of turntable 54 each interfere with projection 104 of lever body 102 as turntable 54 rotates relative to base 24 to hinder continued rotation turntable 54 relative to base 24 when a respective spindle 56 is oriented at the dispense location.

However, user actuation of lever handle 32 in the turntable advance direction communicates a rotational load to turntable 54 that is sufficient to allow the respective spoke 110, 112, 114, 116 to overcome the bias associated with spring 106 and to deflect lever body 102 in an outward or rearward rotational direction relative to base 24 such that the respective spoke can rotate past projection 104 to advance turntable 54, and a subsequent spindle—and associated roll of web material, to the dispense position. Once a respective spoke 110, 112, 114, 116 rotates past projection 104 associated with the deflected orientation of lever body 102, spring 106 returns lever body 102 to an orientation wherein projection 104 of lever body 102 will interfere with a next rotational one of spokes 110, 112, 114, 116 and inhibit rotation of turntable 54 beyond an respective orientation wherein the next subsequent spindle 56, and roll of web material associated therewith, is oriented at the dispense location associated with dispense opening 28.

In still another aspect of the present application, dispenser assembly 20 is constructed to include an additional indexing assembly that is provided as a brake assembly 130 that is constructed to inhibit rotation of turntable 54 relative to housing 21 at a plurality of discrete rotational orientations wherein each relative rotational orientation is associated with one of spindles 56 being oriented at the desired dispense orientation or position proximate opening 28. Referring to FIGS. 8-10, a radially outward directed edge 132 of turntable 54 includes a plurality of brake ridges 134, 136, 138, 140 that are spaced about the circumference of turntable 54 and extend in a generally outward radial direction relative to the axis of rotation of turntable 54. When turntable 54 is associated with base 24 for use, the outward radial edge or circumference of turntable 54 passes through a passage 142 defined by a brake body 144.

Referring to FIG. 11, as a respective spindle approaches the discharge position of being aligned with opening 28, a respective one of brake ridges 134, 136, 138, and 140 frictionally engages a brake surface 146 associated with passage 142 defined by brake body 144. As the respective brake ridge 134, 136, 138, 140 enters passage 142, the contour of the respective ridge 134, 136, 138, 140 and the slideable cooperation with brake surface 146 impedes or hinders rotation of turntable 54 relative to base 24 and thereby the continued rotation of turntable 54 relative to housing 21.

The indexing operation associated with brake assembly 130 allows dispenser assembly 20 to accommodate uneven loading of turntable 54 during the advancement operation, such as when one or more rolls of web material have been dispensed and it is desired to advance another roll of material to the dispense position, in a manner wherein the turntable 54 does not advance the spindle 56 associated with a roll of web material beyond the desired dispense position or location. That is, like indexing assemblies 68, 88, 100, braking assembly 130 is configured to accommodate manual advancement of turntable 54 via operation of lever 36, limit or impede rotation of turntable 54 as a loaded spindle 56 approaches the dispense position, and not impede subsequent advancement of the turntable in response to subsequent operation of advancement lever 36.

It is appreciated that although dispenser assembly 20 includes multiple indexing/braking assemblies 68, 88, 100, 130, dispenser assembly 20 could be provided with any one or more than one of the various indexing/braking assemblies as disclosed therein. That is, it is appreciated that the various physically interfering structures of indexing and braking assemblies 68, 88, 100, 130 could be provided with ramping or contoured structures and/or biasing devises that are configured to limit rotation of the turntable 54 relative to the housing 21, yield to the driving forces associated with operation of the actuation lever 36, and provide the desired rotation between turntable 54 and housing 21 during the various loaded conditions of turntable 54 as dispenser assembly 20 transitions from a fully loaded condition, through a partially loaded condition, and finally to an empty condition.

It should be appreciated that dispenser assembly 20 constructed in accordance with the disclosure above is constructed for manual operation and dispensing of the sheet material associated with each discrete roll of web material associated therewith. It is however further appreciated that dispenser assembly 20 could be constructed to include one or more touch-less operation features and/or highbred operation features wherein the operation of the dispenser assembly 20 can be effectuated in a driven manner rather than a manual manner as disclosed above.

For instance, it is appreciated that dispenser assembly 20 could be constructed to include a controller, sensors, and drive structures associated with dispensing the rolled web material upon detection of a hand placed near the dispenser opening 28. For instance, bypass arm 90 could be provided as a drive roller that is configured to pivot into contact with the roll of web material 31 positioned in the lower, dispensing position 33. Engagement of the elongate bypass arm 90 with the roll of web material provides physical contact with the outer surface of the roll of web material 31 of variable thicknesses, i.e., degrees of roll depletion; and, to allow the roller defined by bypass arm 90 to bias outwardly, away from the perimeter of the spindles and/or rolls of web material associated with the turntable 54 in the event that the lever 36 is actuated to rotate the turntable 54 prior to depletion of the roll of web material 31 in the dispensing position 33 adjacent the opening 28. In this manner, the motion of sensor assembly 88 allows dispensing of the web material associated with the discrete roll 31, 33 in a manner that does not unduly inhibiting rotational motion of the turntable 54. It is further appreciated that one of more of indexing systems 68, 88, 100, 130 could be configured to include discrete sensors associated with providing the controller with information as to the discrete location of turntable 54 relative to housing 21 and/or the number of discrete rolls of web material 31 associated therewith between discrete service events associated with maintaining the operability of dispenser assembly 20.

Therefore, a dispenser assembly according to one embodiment of the present invention and that is configured to sequentially dispense multiple rolls of rolled web material, includes a base and a cover that is attached to the base and movable relative thereto to selectively expose a cavity disposed between the base and the cover. A tray is disposed between the base and the cover and rotational relative to the base and the cover. The tray includes a plurality of spindles that each extend from a surface of the tray and that are each oriented to support a discrete roll of web material. A lever arm is connected to the base and moveable relative thereto. A drive mechanism is disposed between the lever arm and the tray and is constructed to rotate the tray relative to the base with each operation of the lever arm to orient one of the plurality of spindles proximate a dispense opening defined by the base and the cover.

Another embodiment of the present invention that is useable or combinable with one or more of the aspects, features, or embodiments disclosed above defines a dispenser assembly that is configured to dispense multiple rolls of web material and that includes a housing defined by a base and a cover. The base and the cover cooperate with one another to define an interior of the housing and a dispense opening through the housing. A turntable is disposed within the interior of the housing and is configured to rotate within the housing in a generally vertical manner about a drive shaft. The turntable includes a plurality of spindles that each extends from a first surface of the turntable and that are each configured to receive a respective roll of web material. The dispenser assembly includes a lever arm that is accessible from outside the housing and operable to advance the turntable relative to the housing. A drive mechanism is disposed between the lever arm and the turntable and is configured such that rotation of the lever arm in one direction rotates the turntable and rotation of the level arm in an opposite direction does not affect a relative position of the turntable.

A further aspect of the present invention that is useable or combinable with one or more of the features, aspects, or embodiments disclosed above includes a method of forming a multiple roll web material dispenser assembly. The method includes providing a housing that is shaped to generally enclose a cavity and define a dispense opening formed through the housing. A turntable is supported by the housing such that the turntable is rotatable relative to the housing. The turntable includes a plurality of spindles that are each constructed to support a roll of web material. A drive mechanism is supported by the housing and includes a lever that is accessible from outside the housing and operable to rotate the turntable relative to the housing upon rotation of the lever relative to the housing in one direction. An indexing system is provided between the housing and the turntable and is configured to resist rotation of the turntable in response to motion of the lever in the one direction and so that one of the plurality of spindles is generally aligned with the dispense opening defined by the housing.

It is further appreciated that the present invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter of the claims.

What is claimed is:

1. A dispenser assembly configured to sequentially dispense multiple rolls of rolled web material, the dispenser assembly comprising:

a base;

a cover attached to the base and movable relative thereto;

a tray disposed between the base and the cover and rotational relative to the base and the cover, the tray having a plurality of spindles that each extend from a surface of the tray and that are each oriented to support a discrete roll of web material;

a lever arm pivotably connected to a rearward facing surface of the base so that the base is disposed between the tray and the lever arm; and a drive mechanism disposed between the lever arm and the tray, the drive mechanism being constructed to rotate the tray relative to the base with each operation of the lever arm to orient one of the plurality of spindles proximate a dispense opening.

2. The dispenser assembly of claim 1 wherein annular movement of a first end of the lever arm effects rotation of a drive shaft via a gear linkage.

3. The dispenser assembly of claim 2 wherein the drive shaft comprises a geometric cross section about an end thereof and wherein the tray comprises a hub disposed about a central axis having a slot configured to mate with the geometric cross section of the end of the drive shaft.

4. The dispenser assembly of claim 3 wherein the drive mechanism further comprises a one direction clutch bearing disposed between the lever arm and the tray.

5. The dispenser assembly of claim 1 further comprising an indexing assembly configured to retain one of the plurality of spindles proximate the dispense opening after each user actuation of the lever arm.

6. The dispenser assembly of claim 5 wherein the indexing assembly further comprises at least one of a stop arm assembly that is pivotably connected to one of the base and the cover and disposed about a perimeter of the tray, a catch arm pivotably connected to the base and oriented to selectively interfere with rotation of the tray, and at least one brake slot configured to cooperate with a circumferential edge of the tray and inhibit rotation of the tray relative to the base.

7. The dispensing assembly of claim 6 wherein the indexing assembly includes each of a stop arm assembly, a first catch assembly disposed between the base and the tray, and a second catch assembly disposed between the base and the tray and more radially outboard than the first catch assembly and wherein each of the stop arm assembly, first catch assembly, and second catch assembly are biased into engagement to resist rotation of the tray relative to the base.

8. The dispenser assembly of claim 5 wherein the indexing assembly further comprises a biasing device exerting a biasing force on the end of the lever arm of a first magnitude sufficient to retain the end of the lever arm in a receiving slot while web material is dispensed from dispenser.

9. The dispenser assembly of claim 8 wherein the first magnitude of the biasing force exerted by the indexing assembly is less than a second magnitude of force exerted on the drive shaft by annular movement of a first end of the lever arm to effect rotation of the tray relative to the base.

10. The dispenser assembly of claim 1 further comprising at least one brake slot defined by the base and a plurality of projections that are spaced about a circumference of the tray and that each engage the brake slot during rotation of the tray relative to the base.

11. The dispenser assembly of claim 1 further comprising a biasing device exerting a return force on the lever arm after annular movement of a first end of the lever arm to effect rotation of the tray.

12. A dispenser assembly for dispensing multiple rolls of web material, the dispenser assembly comprising:

a housing defined by a base and a cover that cooperate with one another to define an interior of the housing and a dispense opening through the housing;

a turntable disposed within the interior of the housing and configured to rotate within the housing in a generally vertical manner about a drive shaft, the turntable having a plurality of spindles extending from a first surface of the turntable and that are each configured to receive a respective roll of web material;

a lever arm that is pivotably affixed to the base and defines a handle that is accessible from outside the housing at a location opposite the dispense opening; and a drive mechanism disposed between the lever arm and the turntable and configured such that rotation of the lever arm in one direction rotates the turntable and rotation of the lever arm in an opposite direction does not affect a relative position of the turntable.

13. The dispenser assembly of claim 12 further comprising a channel formed in the base and shaped to define an arc of motion of the lever arm relative to the housing.

14. The dispenser assembly of claim 12 wherein the drive mechanism includes a geared interface configured to engage the lever arm, a one-way clutch disposed between the geared interface and the turntable, and a splined interface between the drive mechanism and the turntable.

15. The dispenser assembly of claim 12 further comprising an indexing assembly disposed between the base and the turntable and that defines a plurality of relative rotational orientations of the turntable relative to the base.

16. The dispenser assembly of claim 15 wherein the indexing assembly is at least one of disposed proximate a circumference of the turntable and disposed proximate an axis of rotation of the turntable.

17. The dispenser assembly of claim 16 wherein the indexing assembly further comprises a biasing device orientated to bias a catch supported by the base into engagement with the turntable.

18. The dispenser assembly of claim 17 further comprising a brake arrangement that includes plurality of brake ridges defined by a circumference of the turntable and a restriction associated with the base wherein the brake arrangement is configured to resist rotation of the turntable relative to the base at a plurality of rotational orientations wherein each orientation is associated with a respective one of the plurality of spindles being oriented proximate the dispense opening.

19. The dispenser assembly of claim 12 further comprising a biasing device oriented to exert a biasing force on an end of the lever arm at a magnitude sufficient to restrain the lever arm at a maximum location of the lever arm relative to the base and in the opposite direction.

20. A method of forming a multiple roll web material dispenser assembly, the method comprising:

providing a housing shaped to generally enclose a cavity and define a dispense opening formed therethrough;

supporting a turntable in the housing such that the turntable is rotatable relative to the housing and has a plurality of spindles that are each constructed to support a roll of web material;

providing a drive mechanism that is supported by the housing and includes a lever that extends along a rearward facing outer surface of the housing in a direction away from the dispense opening and is accessible from outside the housing and operable to rotate the turntable relative to the housing upon rotation of the lever relative to the housing in one direction; and providing an indexing system between the housing and the turntable that is configured to stall rotation of the turntable responsive to actuation of the lever in the one direction so that one of the plurality of spindles is generally aligned with the dispense opening.

21. The method of claim 20 further comprising providing a brake arrangement disposed between the turntable and the housing that is configured to impede rotation of the turntable relative to the housing at a plurality of discrete rotational orientations.

22. The method of claim 21 further comprising providing the same number of the plurality of discrete rotation orientations as there are spindles.

23. The method of claim 20 further comprising providing a one-direction drive arrangement between the lever and the turntable.

24. The method of claim 20 further comprising biasing the indexing system toward an orientation wherein the indexing system stalls rotation of the turntable.

25. A dispenser assembly configured to sequentially dispense multiple rolls of rolled web material, the dispenser assembly comprising:

a base;

a cover attached to the base and movable relative thereto;

a tray disposed between the base and the cover and rotational relative to the base and the cover, the tray having a plurality of spindles that each extend from a surface of the tray and that are each oriented to support a discrete roll of web material;

a lever arm connected to the base so that the base;

a drive mechanism disposed between the lever arm and the tray, the drive mechanism being constructed to rotate the tray relative to the base with each operation of the lever arm to orient one of the plurality of spindles proximate a dispense opening; and an indexing assembly configured to retain one of the plurality of spindles proximate the dispense opening after each user actuation of the lever arm, the indexing assembly further comprises at least one of a stop arm assembly that is pivotably connected to one of the base and the cover and disposed about a perimeter of the tray, a catch arm pivotably connected to the base and oriented to selectively interfere with rotation of the tray, and at least one brake slot configured to cooperate with a circumferential edge of the tray and inhibit rotation of the tray relative to the base.

26. The dispensing assembly of claim 25 wherein the indexing assembly includes each of a stop arm assembly and a catch assembly that is disposed between the base and the tray and wherein each of the stop arm assembly and the catch assembly are biased into engagement to resist rotation of the tray relative to the base.

* * * * *